US009138369B1

(12) United States Patent
Chadwell

(10) Patent No.: US 9,138,369 B1
(45) Date of Patent: Sep. 22, 2015

(54) VAULTING MONO-CRUTCH

(71) Applicant: Russell Martin Chadwell, Omaha, NE (US)

(72) Inventor: Russell Martin Chadwell, Omaha, NE (US)

( * ) Notice: Subject to any disclaimer, the term of this patent is extended or adjusted under 35 U.S.C. 154(b) by 0 days.

(21) Appl. No.: 14/202,917

(22) Filed: Mar. 10, 2014

Related U.S. Application Data

(60) Provisional application No. 61/775,684, filed on Mar. 11, 2013.

(51) Int. Cl.
*A61H 3/00* (2006.01)

(52) U.S. Cl.
CPC ..... *A61H 3/00* (2013.01); *A61H 3/008* (2013.01); *A61H 2003/005* (2013.01); *A61H 2003/007* (2013.01)

(58) Field of Classification Search
CPC ..... A61H 3/02; A61H 2003/005; A61H 2003/007; A61H 2201/1633
USPC ..... 135/65, 68; 482/69; 602/5, 19, 23; 623/27, 31
See application file for complete search history.

(56) References Cited

U.S. PATENT DOCUMENTS

| | | | | | |
|---|---|---|---|---|---|
| 572,989 | A * | 12/1896 | Heinecke | 623/31 |
| 4,245,659 | A * | 1/1981 | Shofner | 135/68 |
| 5,348,035 | A * | 9/1994 | Porter | 135/66 |
| 5,673,719 | A * | 10/1997 | Shofner | 135/68 |
| 5,911,234 | A * | 6/1999 | Hirst | 135/68 |
| 6,059,697 | A * | 5/2000 | Breems | 482/67 |
| 6,263,892 | B1 * | 7/2001 | Baker | 135/66 |
| 7,087,030 | B2 * | 8/2006 | Wang | 602/5 |
| 7,549,969 | B2 * | 6/2009 | van den Bogert | 602/16 |
| 2009/0114692 | A1 * | 5/2009 | Roman | 224/660 |
| 2009/0242008 | A1 * | 10/2009 | Thibodeau et al. | 135/84 |
| 2011/0005559 | A1 * | 1/2011 | Daily | 135/68 |

* cited by examiner

*Primary Examiner* — Noah Chandler Hawk
(74) *Attorney, Agent, or Firm* — Advent, LLP

(57) ABSTRACT

A system for enhancing user mobility can include a support member configured to engage a posterior region of a user and a mast coupled to the support member. The mast can be at least partially lifted and repositioned when the user's weight is shifted to a mobile leg of the user, thereby allowing the user to relocate the mast according to an intended direction of movement. The mast is further configured to receive a force exerted on the support member by the user when the weight of the user is shifted away from the mobile leg of the user, thereby enabling the mobile leg of the user to move from a first location to a second location while the weight of the user is shifted from the mobile leg of the user to the mast via the support member.

14 Claims, 16 Drawing Sheets

VAULTING MONO-CRUTCH

PRIORITY

The present application claims priority under 35 U.S.C. §119(e) to U.S. Provisional Patent Application Ser. No. 61/775,684, entitled VAULTING MONO-CRUTCH, By Russell Martin Chadwell, filed Mar. 11, 2013, or is an application of which currently application(s) are entitled to the benefit of the filing date. The above-referenced provisional patent application is hereby incorporated by reference in its entirety.

FIELD OF INVENTION

The present disclosure generally relates to systems and devices for enhancing user mobility and more particularly to a system for assisting a user that suffers from an impaired leg or an amputation.

BACKGROUND

When an individual suffers an injury or an ailment that causes temporary or permanent loss of function in one of the individual's legs, several devices exist to help the individual regain mobility. For example, an impaired individual may use a wheelchair or a crutch depending on the distance being traveled and the individual's ability to compensate for the impaired leg (e.g. status of the individual's other leg, ability to balance, and/or upper body strength). Many users prefer crutches because they enable unassisted navigation up and down stairs and because they enable users to remain mobile in an upright position. Crutches are also more portable and they provide a greater ability to maneuver through doorways, corridors, in and out of vehicles, and around other individuals.

The most commonly used crutches enable a user to compensate for an impaired or missing leg with the user's upper body. To compensate for the user's inability to shift weight from leg to leg, the user shifts weight from the user's mobile (unimpaired) leg to a pair of crutches resting under the user's armpits or forearms. The user is thus enabled to step with the mobile leg while the user's weight is supported by the crutches. However, because of their typical placement, these crutches impose significant strain on the user's upper body and often cause rashes, welts, and/or chafing under the user's armpits or forearms. There is a great need for systems or devices that allow user mobility in an upright position without the deficiencies of currently employed crutches.

SUMMARY

This disclosure is directed to a system for enhancing user mobility by enabling an impaired user to shift weight away from a mobile leg of the user without causing significant strain on the user's upper body or engaging the user in a manner that causes discomfort around the user's armpits or forearms. In accordance with various embodiments of the disclosure, the system includes a support member configured to engage a posterior region of a user, such as the user's buttocks and/or a backside portion of the user just below the user's buttocks (e.g. upper thigh region). The system further includes a mast that is coupled to the support member and is configured to be at least partially lifted from the ground and repositioned when a weight of the user is shifted to a mobile leg of the user. Accordingly, the user may relocate the mast based upon an intended direction of movement (i.e. based upon where the user is planning to step), similar to the manner by which the user would locate a common crutch. Unlike a common crutch, however, the mast is configured to receive a force exerted on the support member by the posterior region of the user when the user's weight is shifted away from the mobile leg of the user. Weight is shifted to the mast through the user's posterior region, thereby allowing the mobile leg of the user to move from a first location to a second location.

The user is enabled to walk for extended periods of time without suffering significant upper body strain or uncomfortable contact because the support member engages the user's posterior region much like the seat of a swing or a parachute harness. While the user steps with the mobile leg, the user's weight is temporarily suspended from the mast via the support member, and as the user raises the mobile leg to step, the transferred weight is stored as potential energy. For example, gravitational forces, tension, and/or user forces cause the mast to be brought to an upright position and may further cause a distortion in the mast and/or a resilient foot coupled to a lower portion of the mast. Much like a reversed pendulum, any energy stored by the mast is released during the downward arc of the step to vault the user in the direction of movement. In embodiments including a semi-resilient mast and/or a resilient foot coupled to the mast, spring forces may further vault and/or stabilize the user as the mast and/or the resilient foot returns to an undistorted state. The system compensates for an impaired or missing leg by preserving the mechanics of a user's walking motion because the user's weight is transferred to the mast through the user's posterior region just as if the user was capable of shifting weight from leg to leg. The operational comfort of the system and its preservation natural walking mechanics will be greatly appreciated by users requiring prolonged or permanent mobility assistance.

It is to be understood that both the foregoing general description and the following detailed description are exemplary and explanatory only and are not necessarily restrictive of the present disclosure. The accompanying drawings, which are incorporated in and constitute a part of the specification, illustrate subject matter of the disclosure. Together, the descriptions and the drawings serve to explain the principles of the disclosure.

BRIEF DESCRIPTION OF THE DRAWINGS

The various embodiments of the disclosure may be better understood by those skilled in the art by reference to the accompanying figures in which.

DETAILED DESCRIPTION

Reference will now be made in detail to the subject matter disclosed, which is illustrated in the accompanying drawings.

Figure 1:
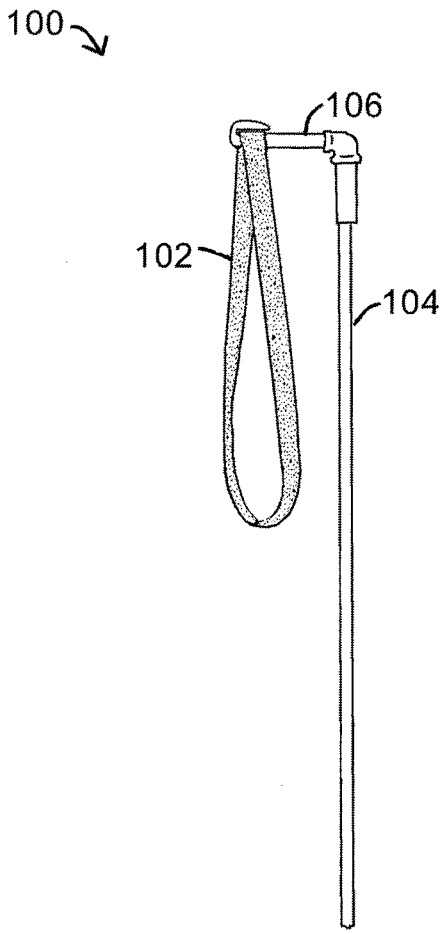
FIG. 1 is a conceptual drawing of a system for assisting user mobility, wherein the system includes a support member coupled to a mast via a structural arm extending from a top portion of the mast, in accordance with an embodiment of this disclosure.

FIGS. 1 through 9 generally illustrate a system 100 for enhancing user mobility by enabling an impaired user 200 to shift weight from away from a mobile leg 202 of the user 200 without placing any additional pressure upon an impaired leg 204 and without causing significant strain on the user's upper body or engaging the user 200 in a manner that causes discomfort around the user's armpits or forearms. As shown in FIG. 1, the system 100 includes a support member 102 coupled with or configured to be coupled with a mast 104 that is held by the user 200 at a side opposite the user's mobile leg 202 (i.e. the side adjacent to the user's impaired leg 204 or adjacent to an amputation). In some embodiments, the mast 104 includes a structural arm 106 coupled with or configured to be coupled with the support member 102, such that the support member 102 may be suspended from the mast 104 by the structural arm 106. As shown in FIG. 2A, the structural arm 106 may extend from a top portion of the mast 104 to a position between the user's shoulders or across the user's chest or upper abdomen to enable the mast 104 to provide support from a location in alignment with or a plurality of locations equidistant from the user's center of mass. Alternatively, the mast 104 may be shorter and may include a structural arm 106 extending across the user's front side above the user's waist, or the mast 104 may be longer and may include a structural arm 106 extending across the user's back side behind the user's neck. Regardless of its placement, the structural arm 106 may enable the user 200 to be supported in a substantially balanced position (i.e. the user 200 is suspended from a center of mass or at least two points substantially equidistant from the center of mass) such that, when weight is shifted away from the mobile leg 202, no significant contortion of the user's body is required to make up for an imbalance that would result if the user 200 were suspended at a strong angle.

Figure 2A:
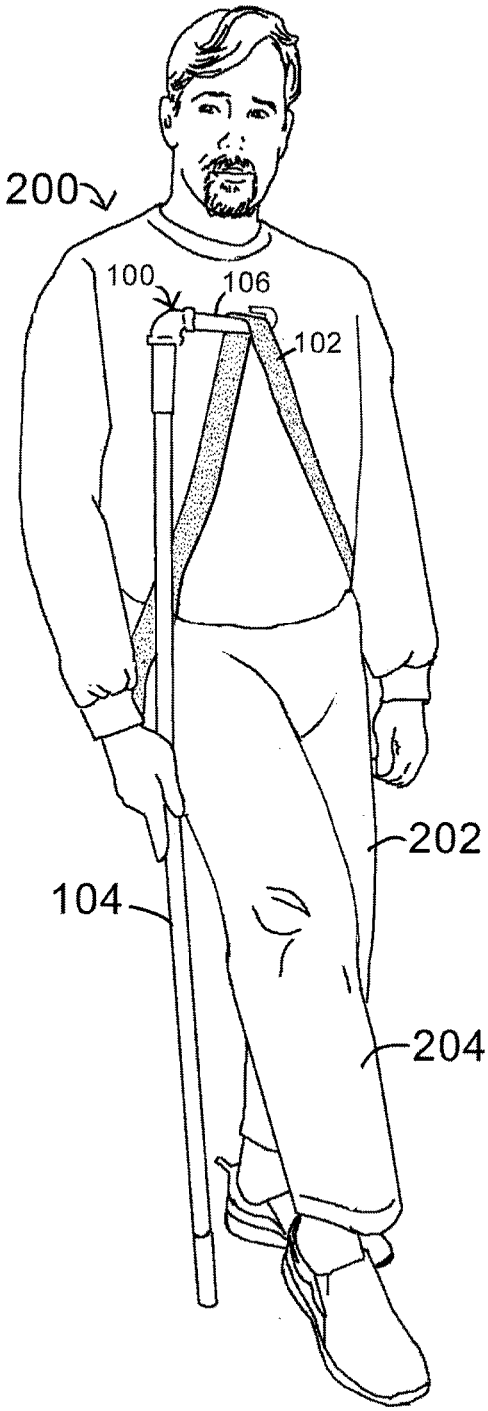
FIG. 2A is a frontal view of a user operating the system for assisting user mobility, in accordance with an embodiment of this disclosure.
Figure 2B:
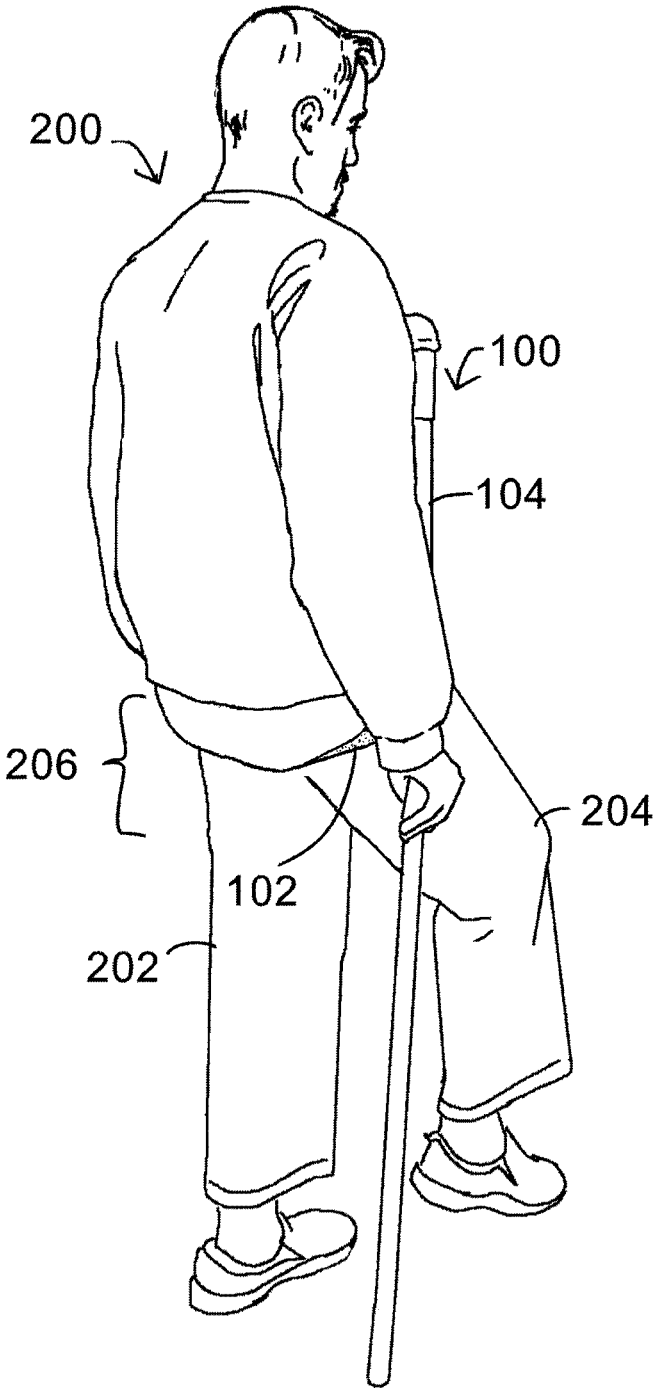
FIG. 2B is a rear view of a user operating the system for assisting user mobility, in accordance with an embodiment of this disclosure.

The mast 104 is configured to be at least partially lifted from the ground and repositioned when the user's weight is shifted to the mobile leg 202, thus allowing the user 200 to relocate the mast 104 based upon an intended direction of movement (i.e. based upon where the user is planning to step), similar to the manner by which the user 200 would relocate a common crutch. Unlike a common crutch, however, the mast 104 is configured to receive a force exerted on the support member 102 by the posterior region 206 of the user 200 when the user's weight is shifted away from the mobile leg 202. For example, as shown in FIG. 2B, the support member 102 is configured to engage a posterior region 206 of a user 200, such as the user's buttocks and/or a backside portion of the user just below the user's buttocks (e.g. upper thigh region). Weight is shifted to the mast 104 through the user's posterior region 206; thereby allowing the mobile leg 202 of the user to move from a first location to a second location (i.e. stepping forwards, backwards, or sideways) while an impaired leg 204 of the user 200 is enabled to hang freely. While the user 200 steps with the mobile leg 202, the user's weight is temporarily suspended from the mast 104 via the support member 102, and as the user 200 raises the mobile leg 202 to step, the transferred weight is stored as potential energy. For example, gravitational forces, tension, and/or user forces cause the mast 104 to be brought to an upright position and may further cause a distortion in the mast 104 and/or a resilient foot coupled to a lower portion of the mast 104. Much like a reversed pendulum, any energy stored by the mast 104 is released during the downward arc of the step to vault the user 200 in the direction of movement. In some embodiments, where the mast 104 is semi-resilient or is coupled to a resilient foot structure, spring forces may further vault and/or stabilize the user 200 as the mast 104 and/or the resilient foot return to an undistorted state. Accordingly, the system 100 mimics the mechanics of a normal walking motion (i.e. natural gait) because the user's weight is transferred to the mast 104 through the user's posterior region 206 just as if the user was capable of shifting weight from leg to leg.

As shown in several of the figures and discussed in accordance with various embodiments, the system 100 can be employed by users 200 having an impaired leg 204 and those suffering an amputation (i.e. missing some or all of one leg) because the mast 104 is enabled to compensate entirely for the supportive function of an impaired or missing leg of the user 200. Thus, it should be understood that the various embodiments system 100 which are described herein are intended for two-legged or one-legged users 200.

Looking now to FIGS. 3A through 8, the support member 102 may be included in a harness comprising a garment, a plurality or straps, linkages, and/or padded structures configured to receive portions of the user's body. Accordingly, the user 200 is enabled to slip into or wear the harness for added comfort, enhanced support, and/or better positioning of the support member 102 relative to the posterior region 206 of the user 200.

Figure 3A:
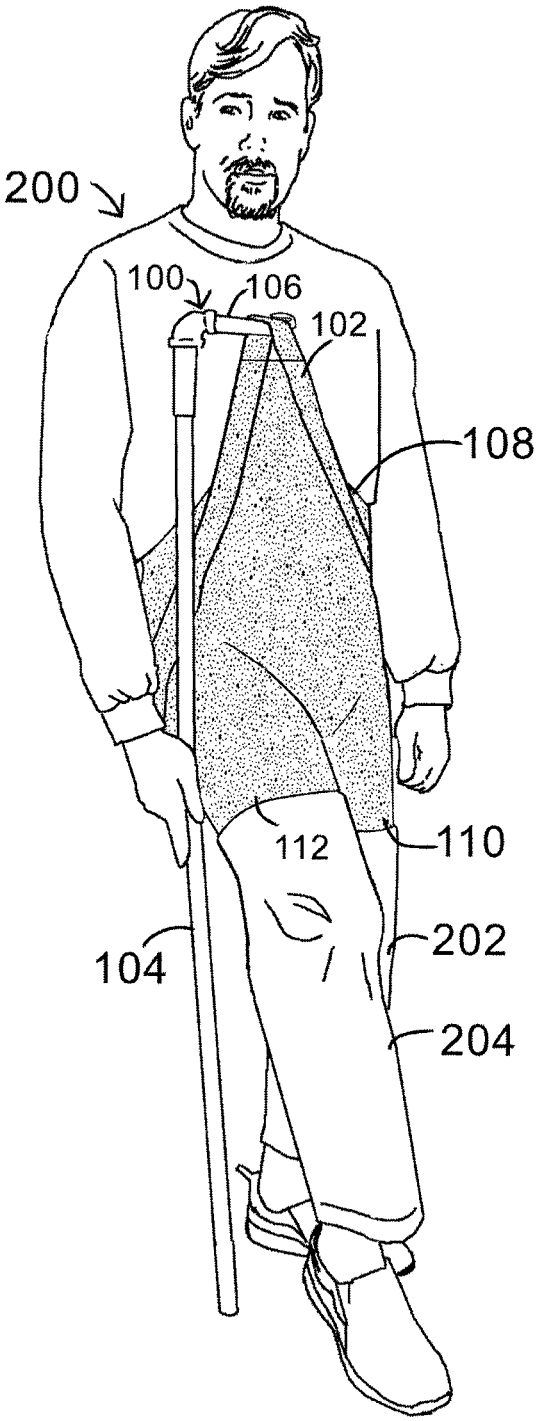
FIG. 3A is a frontal view of a user operating the system for assisting user mobility, wherein the support member is included in a harness comprising a garment having at least one lower fitting for receiving a mobile leg of the user and at least one upper fitting for receiving a portion of the user's torso, in accordance with an embodiment of this disclosure.
Figure 3B:
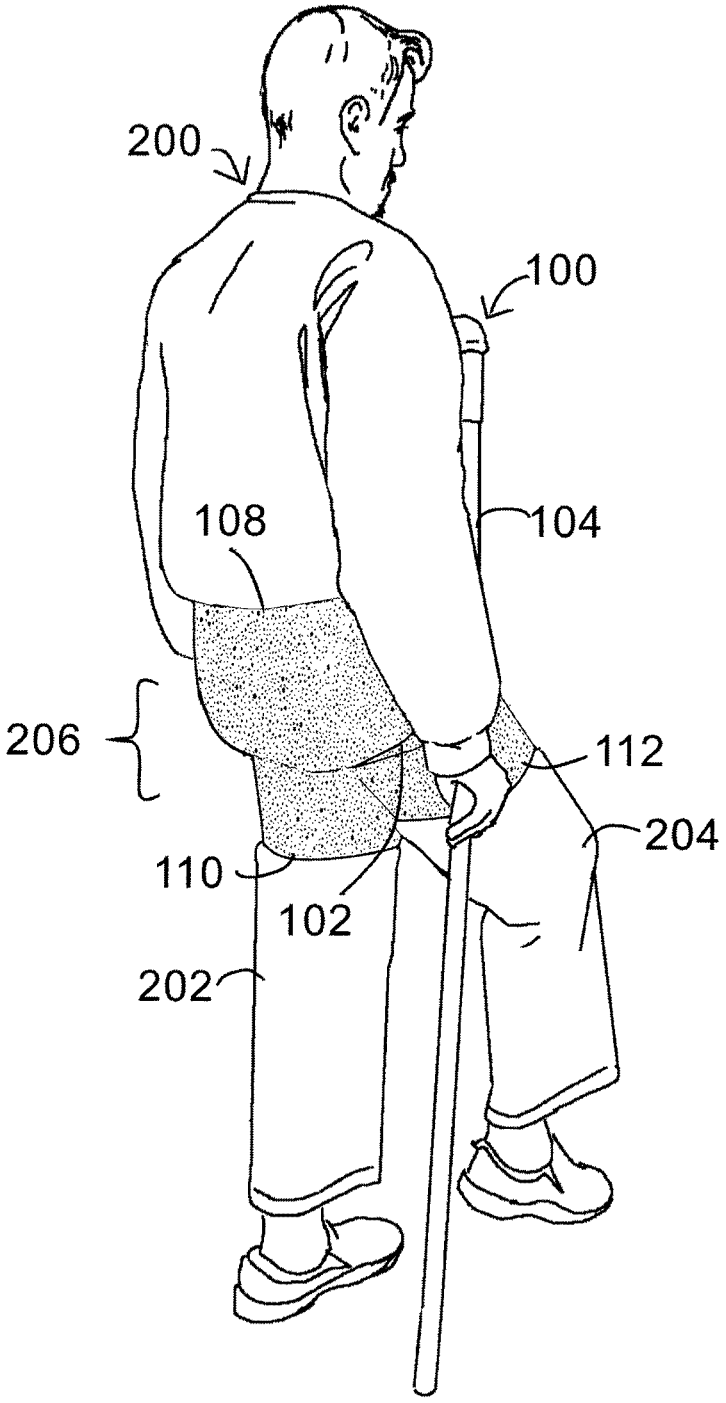
FIG. 3B is a rear view of a user operating the system for assisting user mobility, wherein the support member is included in a harness comprising a garment having at least one lower fitting for receiving a mobile leg of the user and at least one upper fitting for receiving a portion of the user's torso, in accordance with an embodiment of this disclosure.
Figure 3C:
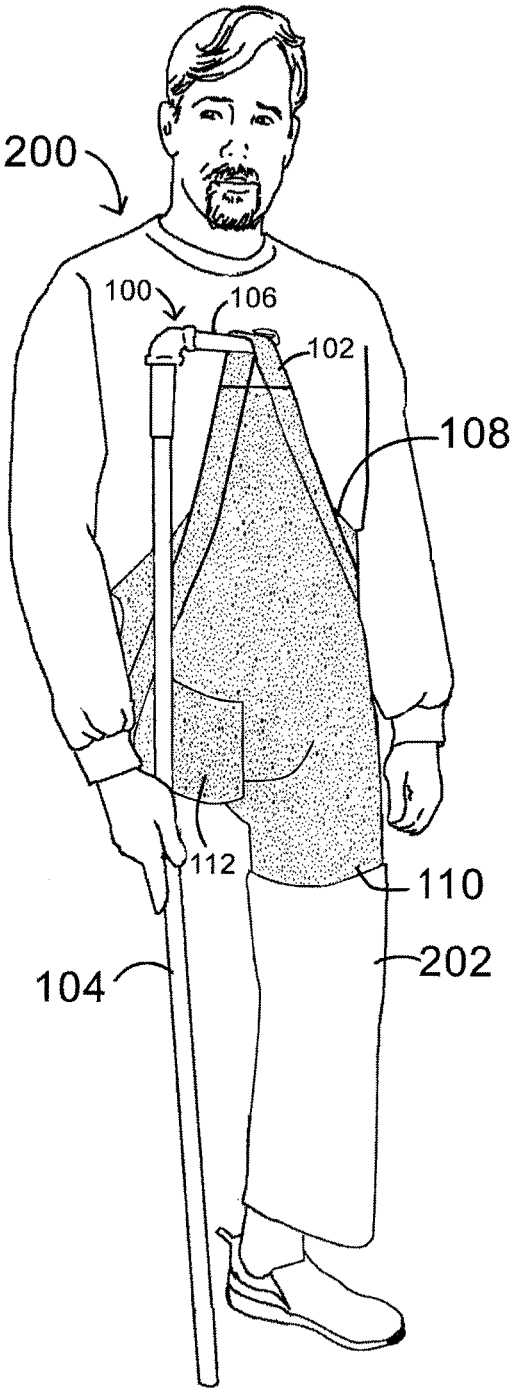
FIG. 3C is a frontal view of a one-legged user operating the system for assisting user mobility, wherein the support member is included in a harness comprising a garment having at least one lower fitting for receiving a mobile leg of the user and at least one upper fitting for receiving a portion of the user's torso, in accordance with an embodiment of this disclosure.
Figure 3D:
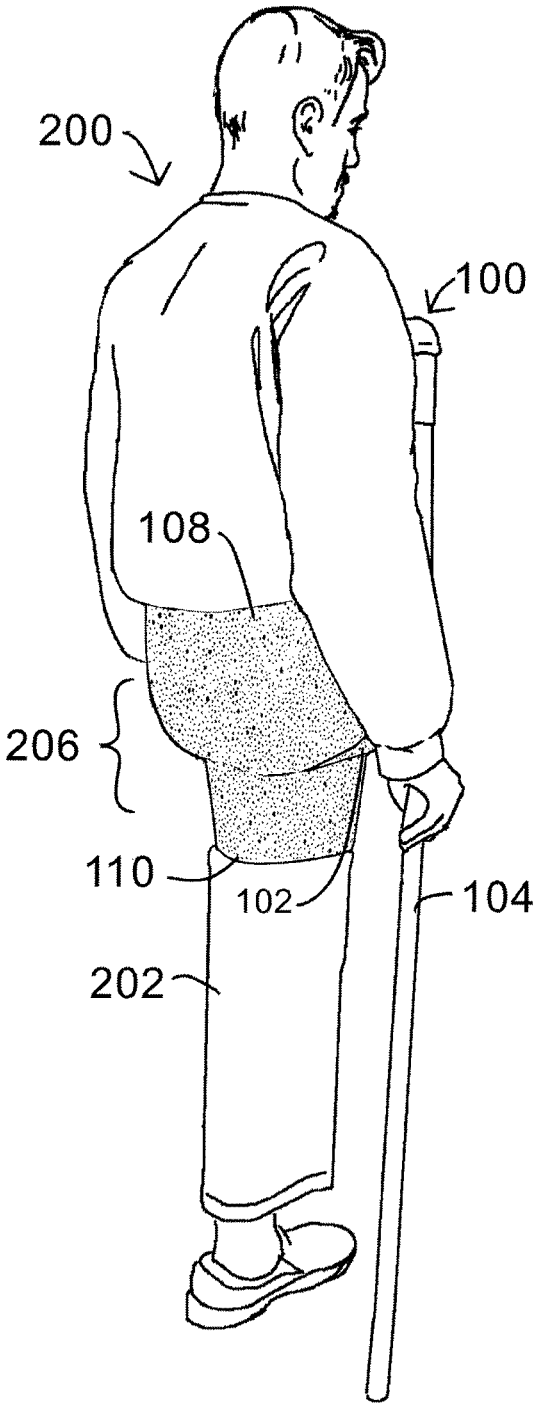
FIG. 3D is a rear view of a one-legged user operating the system for assisting user mobility, wherein the support member is included in a harness comprising a garment having at least one lower fitting for receiving a mobile leg of the user and at least one upper fitting for receiving a portion of the user's torso, in accordance with an embodiment of this disclosure.

FIGS. 3A through 3D illustrate an embodiment of the system 100 including a harness that comprises a garment with at least one lower fitting 110 configured to receive a portion of the user's mobile leg 202. In some embodiments, the garment further includes a second lower fitting 112 that is configured to receive a portion of the user's impaired leg 204. The garment may be sealed in the region of the second lower fitting 112 if it is designed for a one-legged user 200 or portion of the garment defining the second lower fitting 112 may be configured to fold or retract to a closed position (as shown in FIG. 3C) using one or more fasteners, such as VELCRO fasteners, buttons, a zipper, or the like. The garment may further include an upper fitting 108 configured to receive at least a portion of the user's torso, such that the garment covers a portion of the user's body much like a portion of overalls, a scuba suit, or any other body suit. The upper fitting 108 and the lower fitting 110 are coupled with the support member 102 and are configured to maintain the support member 102 in proximity of the posterior region 206 of the user (as shown in FIGS. 3B and 3D). In some embodiments, illustrated in FIGS. 3A and 3C, the upper fitting 108 extends with the support member 102 to location where the support member 102 attaches to the mast 104 via the structural arm 106 in proximity of the user's chest or upper abdomen. In accordance with such embodiments, the upper fitting 108 may be further configured to prevent the user 200 from slipping off of the support member 102 by keeping the user's torso from shifting forward as the mast 104 suspends the user 200 during movements of the mobile leg 202. It is noted herein, that use of the term "fitting" throughout this disclosure is in reference to a structural arrangement of one or more materials forming an opening, cavity, or a generally defined space for receiving or supporting a portion of the user 200.

Figure 4A:
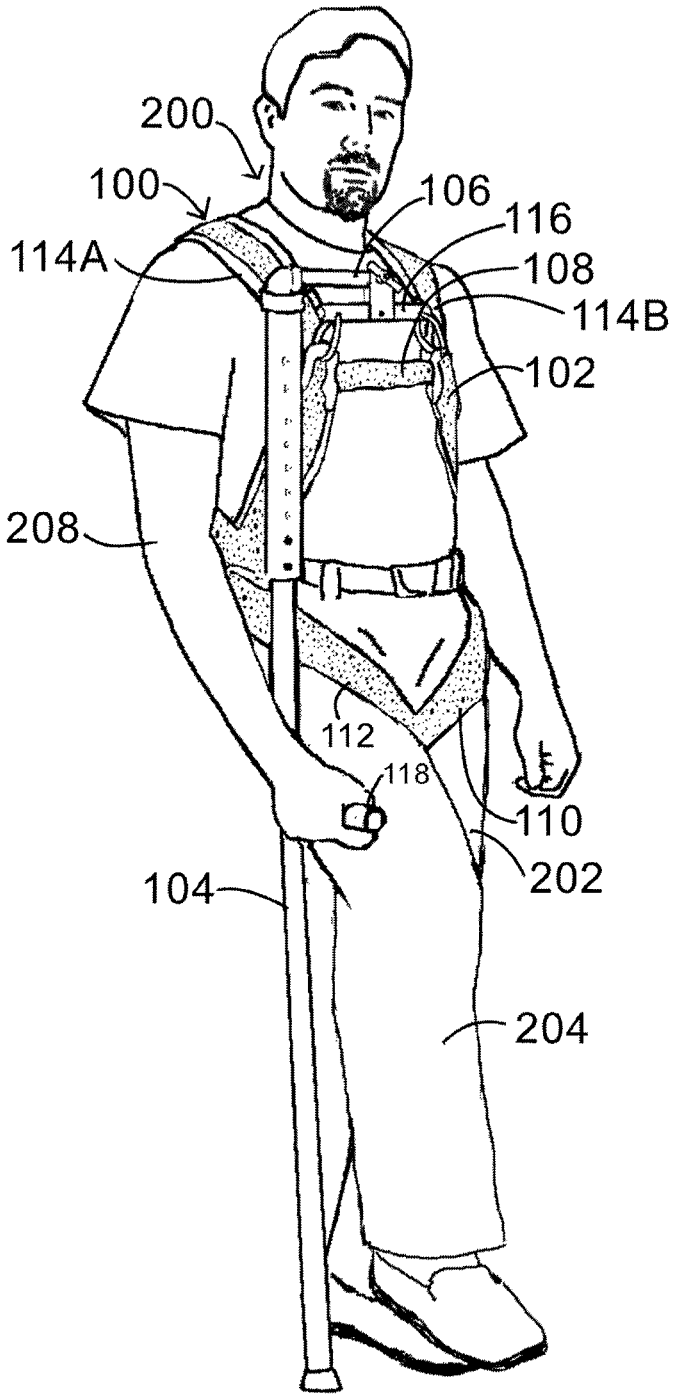
FIG. 4A is a frontal view of a user operating the system for assisting user mobility, wherein the support member is included in a harness comprising a plurality of straps defining at least one lower fitting for receiving a mobile leg of the user, at least one upper fitting for receiving a portion of the user's torso, and at least two side fittings for receiving a portion of the user's shoulders, in accordance with an embodiment of this disclosure.
Figure 4B:
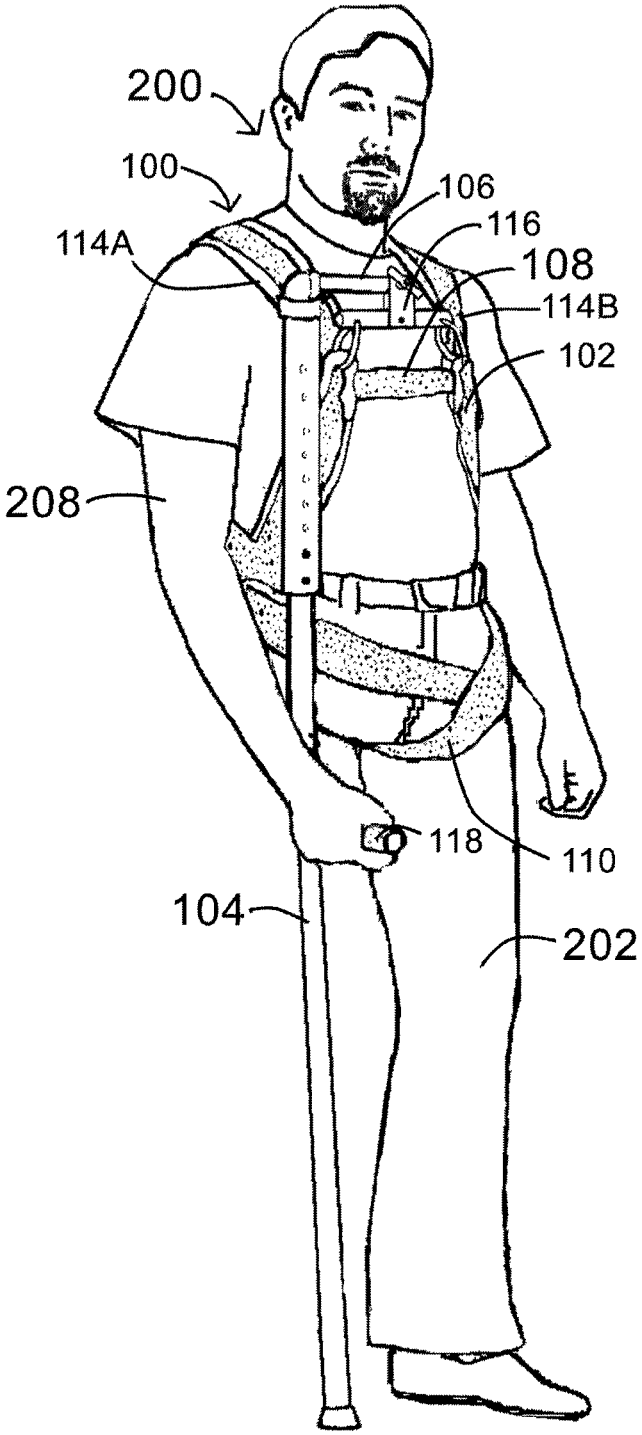
FIG. 4B is a frontal view of a one-legged user operating the system for assisting user mobility, wherein the support member is included in a harness comprising a plurality of straps defining at least one lower fitting for receiving a mobile leg of the user, at least one upper fitting for receiving a portion of the user's torso, and at least two side fittings for receiving a portion of the user's shoulders, in accordance with an embodiment of this disclosure.
Figure 4C:
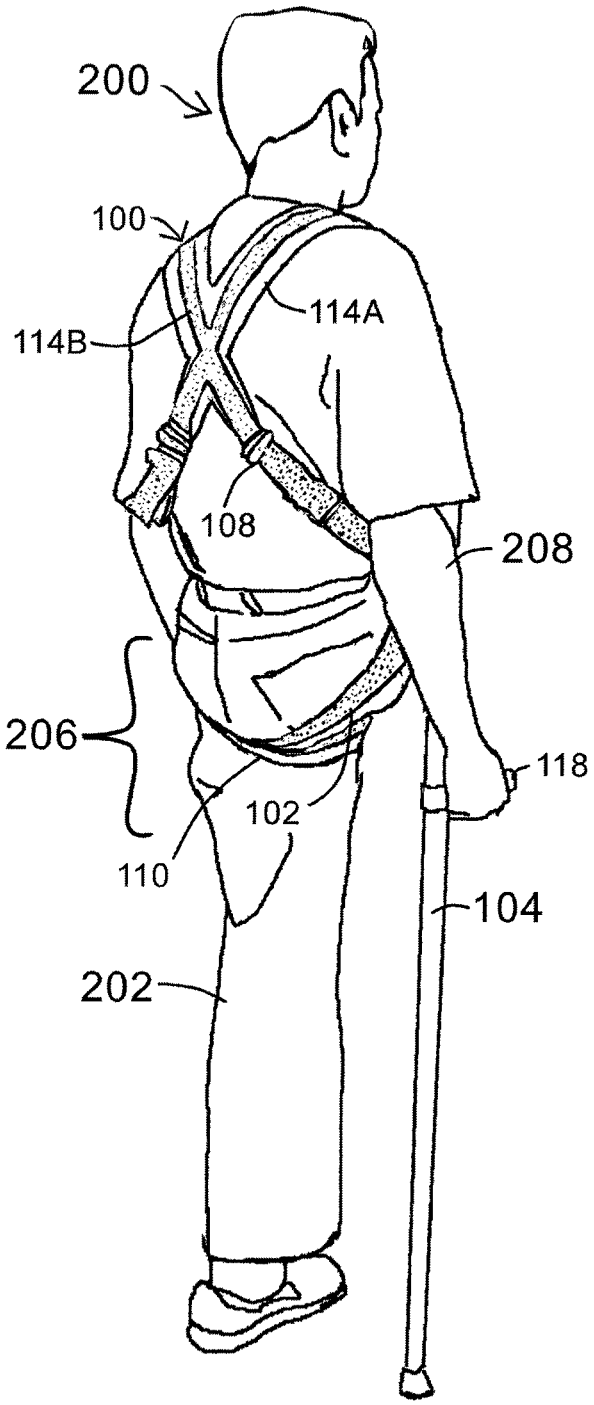
FIG. 4C is a rear view of a one-legged user operating the system for assisting user mobility, wherein the support member is included in a harness comprising a plurality of straps defining at least one lower fitting for receiving a mobile leg of the user, at least one upper fitting for receiving a portion of the user's torso, and at least two side fittings for receiving a portion of the user's shoulders, in accordance with an embodiment of this disclosure.

FIGS. 4A through 4C illustrate an embodiment of the system 100 including a harness that comprises a plurality of straps configured to receive the user's body. In some embodiments, the harness includes one or more straps defining at least one lower fitting 110 that is configured to receive a portion of the user's mobile leg 202. The harness may further include one or more straps defining a second lower fitting 112 that is configured to receive a portion of the user's impaired leg 204. The harness may further include one or more straps defining a first side fitting 114A and one or more straps defining a second side fitting 114B, where the side fittings 114A and 114B are configured to receive a portion of the user's shoulders. In some embodiments, the straps defining the side fittings 114A and 114B also define at least a portion of an upper fitting 108 configured to receive a portion of the user's torso. The upper fitting 108 and/or the lower fitting 110 may be coupled with the support member 102 and configured to maintain the support member 102 in proximity of the posterior region of the user 206 (as shown in FIG. 4C). The upper fitting 108 may be further configured to keep the user's torso from shifting forward as the mast 104 suspends the user 200 during movements of the mobile leg 202.

Further, as shown in FIGS. 4A and 4B, the side fittings 114A and 114B may be coupled with an attachment portion 116 of the support member 102 and configured to suspend the attachment portion 116 in proximity of the user's chest or upper abdomen when the harness is worn. Accordingly, the attachment portion 116 may be maintained in a convenient position for coupling with the structural arm 106 of the mast 104. In some embodiments, the mast 104 is detachable from the harness so that the user 200 can keep wearing the harness when the user 200 is, for example, sitting down or getting into a vehicle. This is much less disruptive then requiring the user 200 remove the harness and put it on again each time the mast 104 needs to be removed. The structural arm 106 may be configured to engage and disengage from the attachment portion 116 using a quick-release pin, gated hook or ring, loops woven into the straps, buckles, or any suitable fastener for suspending a body weight of the user from the mast 104.

Figure 5A:
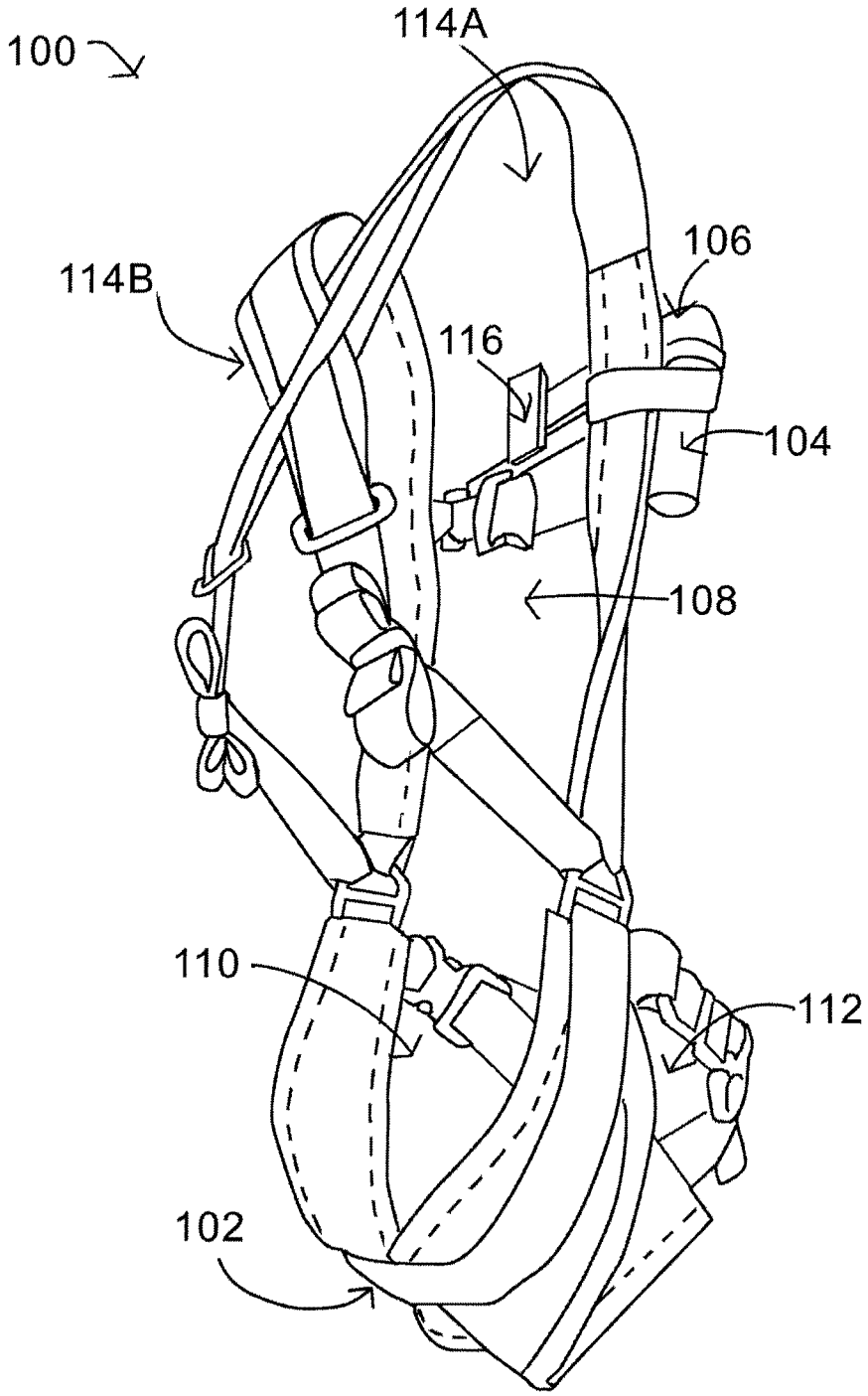
FIG. 5A is a rear view of a harness comprising a plurality of straps defining at least one support member for engaging a posterior region of a user, at least one lower fitting for receiving a mobile leg of the user, at least one upper fitting for receiving a portion of the user's torso, and at least two side fittings for receiving a portion of the user's shoulders, in accordance with an embodiment of this disclosure.
Figure 5B:
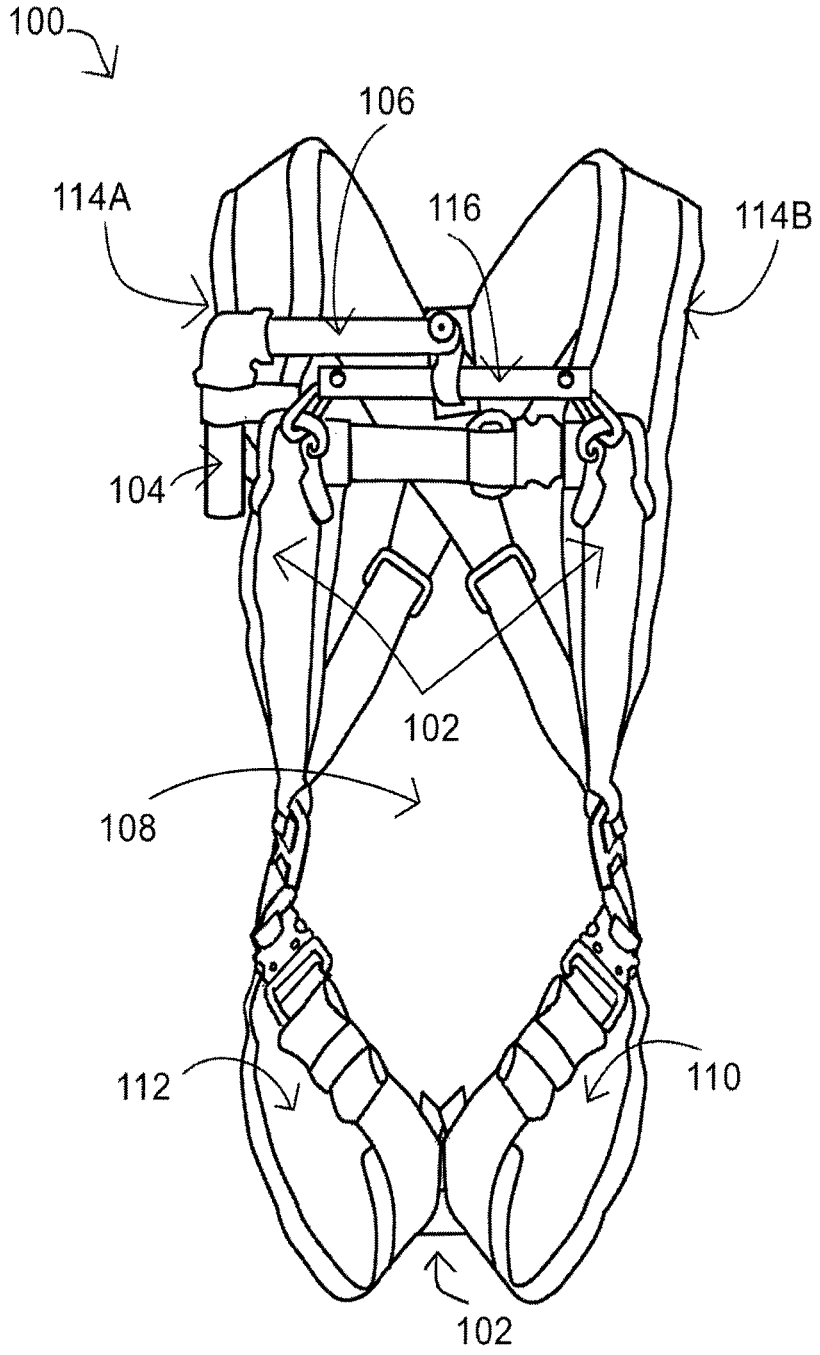
FIG. 5B is a frontal view of a harness comprising a plurality of straps defining at least one support member for engaging a posterior region of a user, at least one lower fitting for receiving a mobile leg of the user, at least one upper fitting for receiving a portion of the user's torso, and at least two side fittings for receiving a portion of the user's shoulders, in accordance with an embodiment of this disclosure.

An exemplary embodiment of the harness is further illustrated in FIGS. 5A and 5B, where the harness includes a pair of torso straps that crisscross along the occupant's mid back and then cross over each shoulder to define the two side fittings 114A and 114B and at least a portion of the upper fitting 108. The torso straps meet again at either hip, predominately serving to secure the harness to the user's torso. Along the user's back, torso strap adjustment buckles may be situated in such way that the user can adjust the length of the torso straps. Each of the torso straps may include a padded portion (e.g. nylon filled with fibrous nylon) serving to provide comfort padding over the user's shoulders. The torso straps may further connect along the front side of the user 200 (e.g. over the user's chest or upper abdomen) by way of a chest strap. A chest strap fastener (e.g. steel or plastic buckle) may enable coupling of the torso straps together at the front side of the user, further defining a portion of the upper fitting 108 by bridging the torso straps at the user's chest or upper abdomen. In some embodiments, the chest strap may further include an adjustment buckle for configuring the length of the chest strap. Along an outward surface of the chest-portion the torso straps, as set of D-ring loops may serve as anchoring points for the attachment portion 116 of the support member 102.

At the right and left hip-areas of the user 200, the torso straps may join to a pair of torso-to-seat strap, three-way fasteners. The three-way fasteners serve to connect the torso straps to a seat strap defining at least a portion of the support member 102 that is configured to engage the posterior region 206 of the user 200. The seat strap may be made from a thicker, stronger, or reinforced material in comparison to the torso or leg straps. The seat strap may further include comfort padding along a region between the support member 102 and the posterior region 206 of the user 200. A leg strap fastener may be attached at an angle to the seat strap, serving to anchor an end of a leg strap defining at least a portion of the lower fitting 110 and/or to anchor an end of an optional lower waist strap defining at least a portion of the upper fitting 108.

A first lower fitting 110 and (in some embodiments) a second lower fitting 112 may be defined by a pair of detachable leg straps connected to the three-way fasteners, on either side of the user's hips. The leg straps may serve to stabilize the user 200 onto the seat strap, allowing the user 200 to sit on the seat strap much like a seat of a playground swing set. The leg straps, when connected to the three-way fasteners may define loops configured to receive the user's legs 202 and 204, thus defining the lower fittings 110 and 112. A leg strap adjustment buckle may be connected into each leg-strap fastener to allow configuration of the leg strap length according to the user's needs. As discussed above, the leg straps may be detachable, thus allowing the user to configure the harness for one-legged or two-legged operation. If the user 200 is missing a leg, one of the leg straps may be detached from a respective one of the three-way fasteners and a respective seat strap connection. The leg strap may be replaced with an optional lower-waist strap configured to connect via the leg strap fastener to the seat strap. The lower-waist strap may cross over the front side of the user's lower waist, reaching around to the opposite-side leg strap in a manner that better secures the one-legged user onto the seat (as shown in FIG. 4B).

In an exemplary embodiment, the attachment portion 116 (i.e. the crutch-to-harness connection) may include a tubular chest bar that is connected to the D-rings by way of a set of small o-rings or any other fastener that provides a strong mounting point between harness and the structural arm 106 of the mast 104. A small u-bar connects the chest bar to the structural arm 106 by way of a high-strength quick-release pin. This allows the user to disconnect from the mast 104 for any number of reasons. In some embodiments, the quick-release pin joins the chest bar to the structural arm 106, while the structural arm 106 is joined to the mast 104 via an elbow connection. Alternatively, the structural arm 106 may be integrated with or welded to the mast 104. In some embodiments, the mast further includes a height-adjustment tube, which may be coupled with the elbow connection. The adjustment tube may include various adjustment holes configured to receive a locking pin at a selected height of the mast 104. Accordingly, the mast 104 may be enabled extended from or collapsed into the adjustment tube according to a selected length of the mast 104. The mast 104 may be formed from a rigid (e.g. steel) or a semi-rigid material (e.g. fiberglass or isophthalic polyester resin) and may have one or more pin holes aligned in such way that when slid inside the adjustment tube, the matching hole-patterns provide an interface for anchoring the crutch at a given height with one or more pins (slid through the aligned holes). In some embodiments, the adjustment tube may include alternative adjustment couplings such as, but not limited to, a crank configured to actuate rigid tooth-like structures or notches along a portion of the mast 104, a pressurized canister (as often used for desk chairs), a locking lever (as often used for bicycle seat or handle bar adjustments), or cooperative threading (i.e. a screw-style coupling between a portion of the mast 104 and the adjustment tube).

In some embodiments, the adjustment tube may further include at least one actuator, such as a motor, configured to raise and lower the tube relative to the rest of the mast 104. Accordingly, the mast height may be electronically controlled using a switch, which may be located, for example, in a handle coupled to the mast 104. It is further contemplated that an electronically adjustable mast 104 may be configured to responsively shorten or lengthen according to the user's gait. For example, the mast 104 may be configured to shorten during relocation so that the user 104 is not required to swing the mast 104 outwards.

Figure 6:
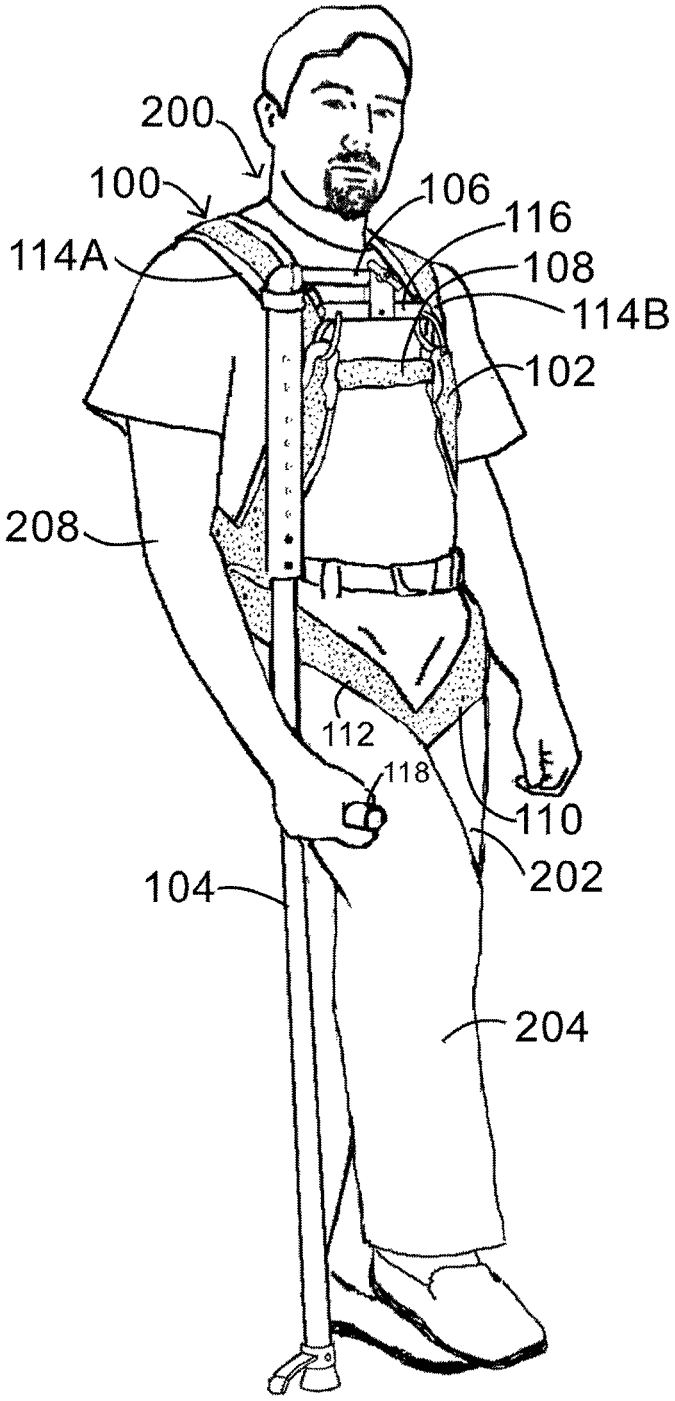
FIG. 6 is a frontal view of a user operating the system for assisting user mobility, wherein the mast includes a handle and a structural foot, in accordance with an embodiment of this disclosure.
Figure 7A:
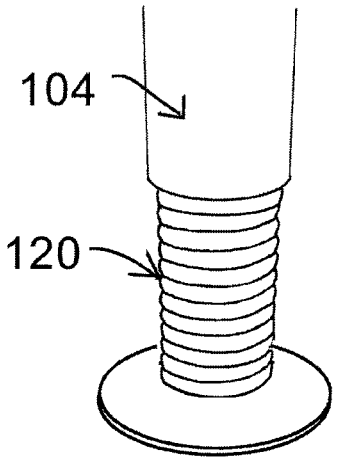
FIG. 7A is a conceptual drawing of a spring-loaded foot, in accordance with an embodiment of this disclosure.
Figure 7B:
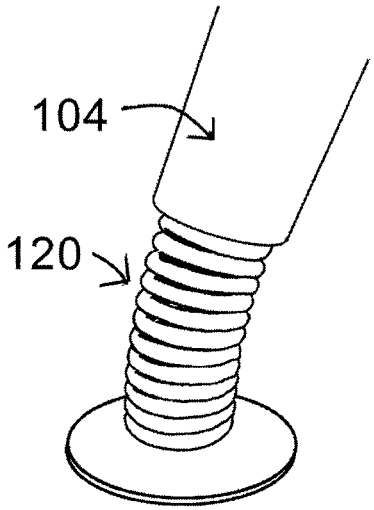
FIG. 7B is a conceptual drawing of a spring-loaded foot, in accordance with an embodiment of this disclosure.
Figure 7C:
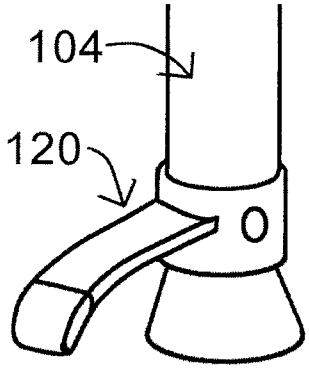
FIG. 7C is a conceptual drawing of a structural foot, in accordance with an embodiment of this disclosure.
Figure 8:
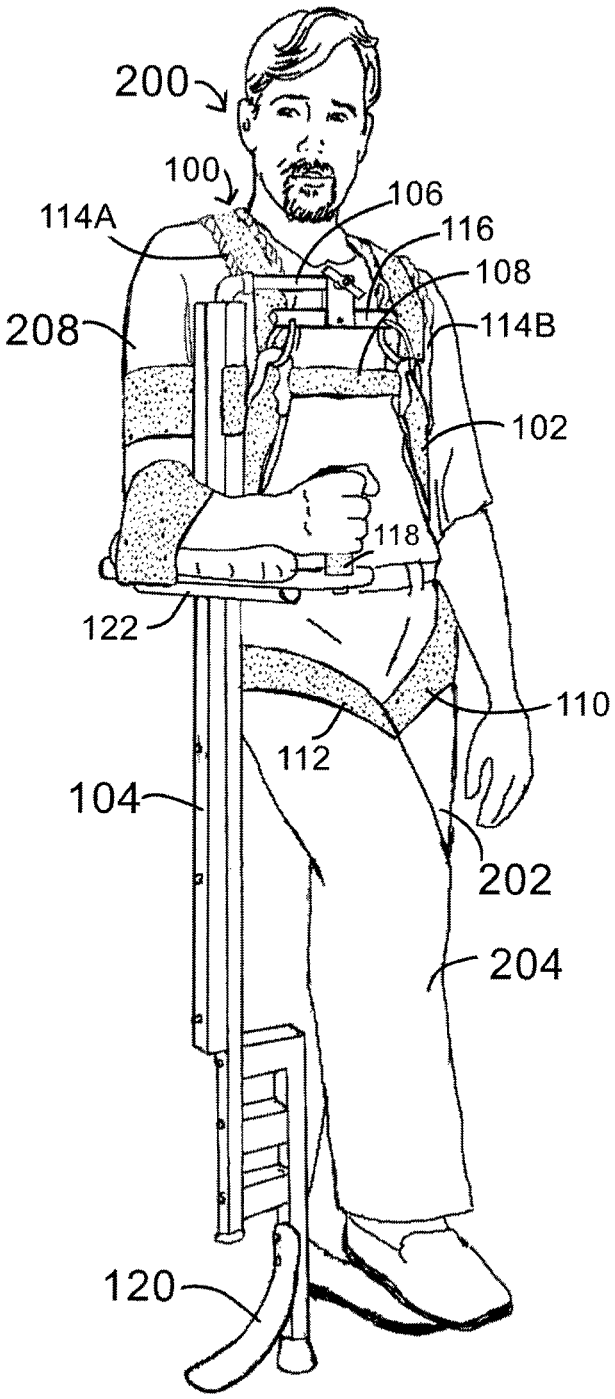
FIG. 8 is a frontal view of a user operating a system for assisting user mobility, wherein the mast includes a handle coupled to a forearm support member and a structural foot comprising a resilient fin, in accordance with an embodiment of this disclosure.

In some embodiments, where the mast 104 is formed from a semi-rigid or semi-resilient material, the resiliency allows the user 200 to make minor upper-body movements in order to adjust his or her center of mass while stepping with the mobile leg 202. The mast 104 may slightly distort as weight is shifted to the mast 104 and push the user 200 back to center with a restoring force as the mast 104 returns to an undistorted state. As shown in FIG. 6, the mast may further include a handle 118 allowing the user 200 to exercise improved control over the mast 104. The mast 104 may further include a structural foot 120 configured to stabilize the mast 104 when the user 200 leans outwards. The structural foot may extend outwards from a bottom portion of the mast (as shown more clearly in FIG. 7C). In some embodiments, the structural foot 120 is a spring-loaded foot (as shown in FIGS. 7A and 7B) or a resilient fin (as shown in FIG. 8) that is enabled to distort as weight is shifted to the mast 104 and return a restoring force as it is undistorted. Embodiments including a resilient mast 104 and/or a resilient foot 120 extending from a bottom portion of the mast 104 may allow for improved stability and fluidity of motion as the user 200 steps.

As shown in FIG. 8, the mast 104 may be reinforced to bear the weight of an inexperienced or heavier user 200. In such embodiments, it is particularly advantageous to include a resilient foot 120 so that fluidity of motion is not compromised due to the rigidity of the reinforced mast 104. For inexperienced users 200 or those suffering more extensive injuries or ailments or simply for added comfort, the mast 104 may further include a padded forearm support member 122 coupled with handle 118. The forearm support member 122 may be configured to receive the user's forearm in a resting position may assist in maintaining the user 200 in an upright position with added support for the user's back and shoulders.

In an exemplary embodiment, the mast 104 may further include a traction tip, providing slip-resistant traction with the ground. As discussed above, the mast may further include one or more optional components for providing additional control or comfort. For example, the optional handle 118 may be affixed along the mast 104 in order to provide the user 200 with a better grasp of the mast 104. If more control is desired, the mast 104 may further include the forearm support member 122 with one or more straps affixing the user to the mast 104 itself (as shown in FIG. 8). The forearm support member 122 coupled with the handle 118 may be arranged at a right angle to the mast 104, allowing the user 200 to strap his or her forearm onto the support member 122 in a resting position for added comfort and improved control over the mast 104. The structural foot 120 may be further included to provide additional control over the user's center of mass. The structural foot 120 may be semi-resilient, orthogonal-to-travel, and/or optionally detachable. In some embodiments, the structural foot 120 is a fin-like structure (i.e. a somewhat flat foot) offering some resiliency to allow the user 200 to lean onto the user's impaired side with greater confidence and launch the mobile leg 202 forward with much greater ease and confidence. As a user 200 learns to exercise better control over his or her center of mass, the structural foot may be detached to allow for a narrower walking path. In general, it is contemplated that many of the optional or enhanced components can be removed from the system 100 or reduced in complexity as the user 200 is in later stages of recovery or has learned to balance more proficiently.

Moreover, the system 100 is highly configurable according to the user's needs. For example, heavy-chested or overweight users may find better comfort utilizing an embodiment like that shown in FIG. 6 or FIG. 8, where the system 100 includes a harness with widely-placed straps or at least a wider association between straps and structural arm 106. Further, a longer mast 104 may be utilized to ensure that the structural arm 106 is located at a height slightly above the problem area in question (i.e. the user's chest region). To avoid undesirable pressure in the chest region of the user 200, the D-rings or any other attachment portion 116 for coupling with the structural arm 106 may also be set at higher point on the harness. This is but one example of a user configuration or selection that may further enhance comfort for individuals of different shapes and sizes. Those skilled in the art will appreciate that many additional or alternative adjustments, component selections, and/or configurations may be made to the system 100 to accommodate a user's needs, and that the embodiments illustrated in FIGS. 1 through 9 are included for illustrative purposes and are not restrictive of the present disclosure.

Figure 9:
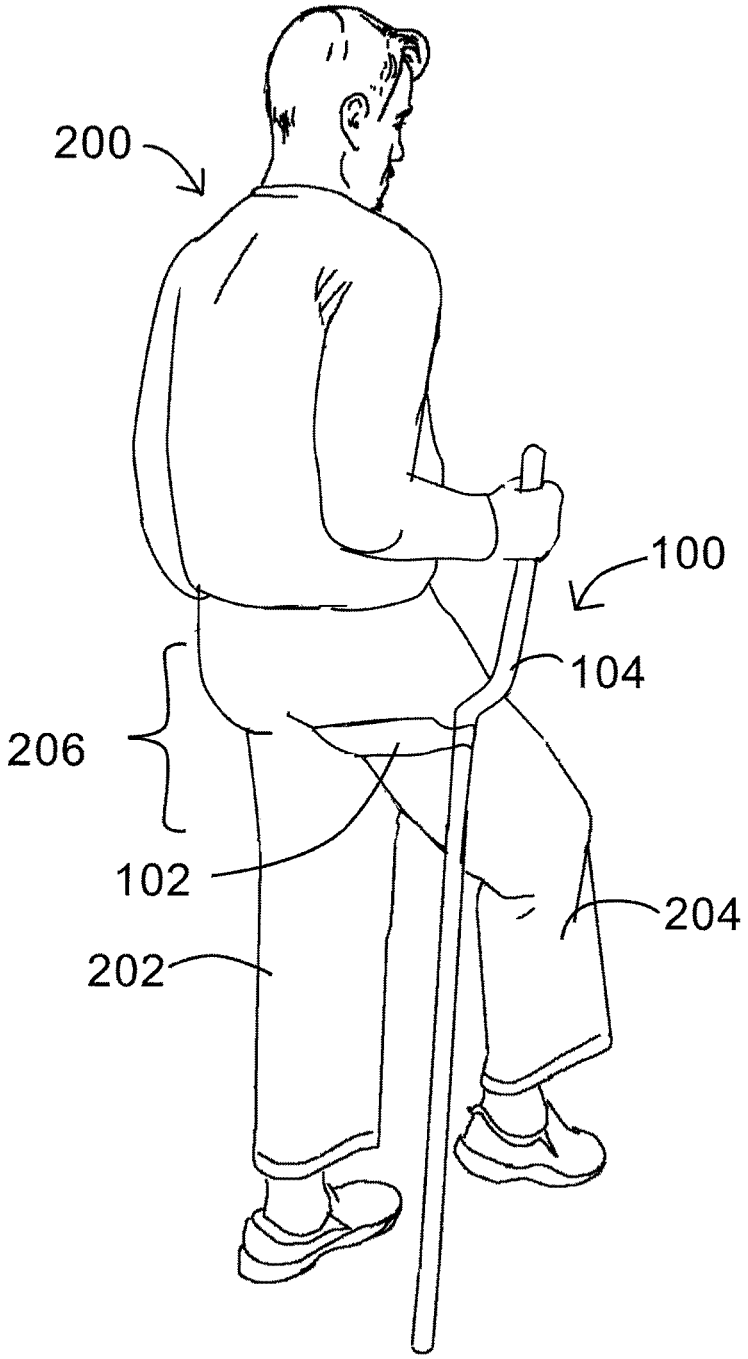
FIG. 9 is a rear view of a user operating a system for assisting user mobility, wherein the mast is coupled to a rigid support member extending from a portion of the mast in proximity of a posterior region of the user, in accordance with an embodiment of this disclosure.

FIG. 9 illustrates yet another embodiment of the system 100, wherein the support member 102 is rigidly attached to a portion of the mast 104 in proximity of the posterior region 206 of the user 200. For example, the support member 102 may comprise a rigid platform extending from the mast 104 and configured to engage the posterior region of the user 206 when the user 200 shifts weight away from the mobile leg 202. According to such embodiments, the system 100 may have a much lower profile, similar to that of a cane, while still supporting the user 200 from a location just above the impaired leg 204 or an amputation. The mast 104 may extend to a position just above the user's waist or lower abdomen to enable the user 200 to comfortably control the mast 104 (i.e. enabling the user 200 to relocate the mast 104 when the user's weight is shifted back to the mobile leg 202).

Numerous advantages of the system 100 will be appreciated by those skilled in the art. For example, this system 100 maintains tension, gravitational, and incidental forces at a point near the hip joint, as it should be, instead of on hands, under arms and so forth, as seen in common crutches. The system 100 also allows the user 200 to maintain a free hand, as only one hand is needed to control the mast 104 at all times, unlike crutches which are typically operated in pairs. The system 100 also offers several advantages over prosthetics. For example, because it is highly reconfigurable, the system 100 may be provided to users at a much lower cost than prosthetics, which can run anywhere from $5,000 to $50,000. The cost advantages are multiplied when one considers that prosthetics, due to their complex nature, often need to be replaced due to wear, sometimes in as little as four to five years. The adjustable nature of the system 100 also allows any user 200 to begin learning to navigate with much less training, unlike prosthetics, which must be highly customized to the user's body and may require extensive training periods.

Additionally, leg prosthetics for above-the-knee amputations are known to exhibit low performance in negotiation of steep inclines. There are a few prosthetics that perform well on inclined hills, and these are typically top-end (very expensive) models. The problem is that when a user tries to bring the artificial foot of a prosthetic up to the same level as the good foot and then tries to advance the good foot up to the next higher point, the user is left on the toe of the artificial foot and the length of the artificial foot allows the user to roll back onto its heel. This potentially launches the user off in an inappropriate direction (e.g. backwards). The mechanical knee is also not powered in such a way that it can lift the user up to the next higher point. Rather, the mechanical knee typically has enough spring power only to put the foot in a more forward position while on nearly-level ground. When attempting to move the foot to a significantly higher point than it was previously, the width and length of the artificial foot becomes an issue. The mast 104 described above includes a small, tapered end that is not susceptible to this scenario. The user 200 simply advances the mobile leg 202 to the higher point and brings the mast 104 up to the same level.

It will be understood by those within the art that, in general, terms used herein, and are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations.

In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.).

In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

Although particular embodiments of this invention have been illustrated, it is apparent that various modifications and embodiments of the invention may be made by those skilled in the art without departing from the scope and spirit of the foregoing disclosure. Accordingly, the scope of the invention should be limited only by the claims appended hereto.

What is claimed is:

1. A system for enhancing user mobility, comprising:

a support member configured to engage a posterior region of a user;

a mast coupled to the support member, the mast being configured to be at least partially lifted from the ground and repositioned when a weight of the user is shifted to a mobile leg of the user, the mast being further configured to receive a force exerted on the support member by the user when the weight of the user is shifted away from the mobile leg of the user, wherein the mobile leg of the user is enabled to move from a first location to a second location when the weight of the user is shifted from the mobile leg of the user to the mast via the support member; and a structural arm extending from a top portion of the mast at least half way across the user's chest or upper abdomen, the structural arm being configured to suspend the support member from a suspension point near the center of the user's chest or upper abdomen such that the support member carries the user and is fully suspended from the structural arm as the weight of the user is shifted away from the mobile leg of the user, wherein the structural arm is structured to extend across a frontside of the user such that the mast and the structural arm are maintained in front of, and not in contact with, the user's armpits.

2. The system of claim 1, wherein the mast is further configured to distort as the force is exerted on the support member by the user, thereby storing energy from the force, and wherein the mast is further configured to exert a restoring force as the mast returns to an undistorted state, thereby propelling the user as the mobile leg of the user is moved from the first location to the second location.

3. The system of claim 1, wherein the mast includes a structural foot extending from a lower portion of the mast, the structural foot being configured to stabilize the mast as the mobile leg of the user is moved from the first location to the second location.

4. The system of claim 3, wherein the structural foot is further configured to distort as the force is exerted on the support member by the user, thereby storing energy from the force, and wherein the structural foot is further configured to exert a restoring force as the structural foot returns to an undistorted state, thereby propelling the user as the mobile leg of the user is moved from the first location to the second location.

5. The system of claim 4, wherein the structural foot comprises at least one of a spring-loaded foot or an outwardly projecting fin.

6. The system of claim 1, wherein the length of the mast is greater than or equal to a distance from the ground to the user's chest.

7. The system of claim 1, wherein the posterior region of the user includes at least a portion of the user's buttocks or a backside portion of the user that is located below the user's buttocks.

8. The system of claim 1, wherein the mast includes a handle for controlling the mast with an arm of the user that is opposite to the mobile leg of the user.

9. The system of claim 8, wherein the mast further comprises a forearm support member coupled to the handle, the forearm support member being located at a position on the mast suitable for resting the user's forearm when the user is in a standing in an upright position.

10. A system for enhancing user mobility, comprising:

a harness including: a support member configured to engage a posterior region of a user; an upper fitting configured to receive a portion of the user's torso; and a lower fitting configured to receive a portion of a mobile leg of the user, the upper fitting and the lower fitting of the harness being coupled with the support member and configured to maintain the support member in proximity of the posterior region of the user; and a mast configured to be controlled by the user with an arm opposite to the mobile leg of the user, the mast being configured to be at least partially lifted from the ground and repositioned when a weight of the user is shifted to a mobile leg of the user, the mast including a structural arm extending from a top portion of the mast to a location proximate to the user's chest or upper abdomen, the structural arm being coupled to the support member and being configured to transfer a force exerted on the support member by the user to the mast as the weight of the user is shifted away from the mobile leg of the user such that the support member carries the user and is suspended from the structural arm, wherein the mobile leg of the user is enabled to move from a first location to a second location when the weight of the user is shifted from the mobile leg of the user to the mast via the support member that is suspended from the structural arm, and wherein the structural arm is structured to extend across a frontside of the user such that the mast and the structural arm are maintained in front of, and not in contact with, the user's armpits.

11. The system of claim 10, wherein the mast is further configured to distort as the force is exerted on the support member by the user, thereby storing energy from the force, and wherein the mast is further configured to exert a restoring force as the mast returns to an undistorted state, thereby propelling the user as the mobile leg of the user is moved from the first location to the second location.

12. The system of claim 10, wherein the mast further includes a structural foot extending from a lower portion of the mast, the structural foot being configured to stabilize the mast as the mobile leg of the user is moved from the first location to the second location.

13. The system of claim 12, wherein the structural foot is further configured to distort as the force is exerted on the support member by the user, thereby storing energy from the force, and wherein the structural foot is further configured to exert a restoring force as the structural foot returns to an undistorted state, thereby propelling the user as the mobile leg of the user is moved from the first location to the second location.

14. The system of claim 10, wherein the harness further includes two side fittings configured to receive a portion of the user's shoulders, the two side fittings being coupled to the support member and configured to maintain an attachment portion of the support member in proximity of the user's chest or upper abdomen, the attachment portion of the support member being configured to couple with the structural arm of the mast.

* * * * *